US009498061B2

(12) United States Patent
Liang et al.

(10) Patent No.: US 9,498,061 B2
(45) Date of Patent: Nov. 22, 2016

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Hsiu-Chiang Liang, Kaohsiung (TW); Ken-Ching Chen, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 60 days.

(21) Appl. No.: 14/623,839

(22) Filed: Feb. 17, 2015

(65) Prior Publication Data

US 2016/0235199 A1 Aug. 18, 2016

(51) Int. Cl.

*A47B 88/00* (2006.01)
*A47B 88/14* (2006.01)
*A47B 88/04* (2006.01)

(52) U.S. Cl.

CPC ..... *A47B 88/14* (2013.01); *A47B 88/0422* (2013.01)

(58) Field of Classification Search

CPC ... A47B 88/10; A47B 88/14; A47B 88/0422
See application file for complete search history.

(56) References Cited

U.S. PATENT DOCUMENTS 5,433,517 A * 7/1995 Fleisch ..... A47B 88/10 312/334.46
6,390,574 B2 * 5/2002 Fraccaro ..... A47B 88/10 312/333
6,945,620 B2 * 9/2005 Lam ..... A47B 88/10 312/334.12
7,296,863 B2 * 11/2007 Lam ..... A47B 88/10 312/334.15
7,309,115 B2 * 12/2007 Blum ..... A47B 88/14 312/334.13
7,905,561 B2 * 3/2011 Ritter ..... A47B 88/10 312/333
8,186,780 B2 * 5/2012 Liang ..... A47B 88/0422 312/334.5
8,430,567 B2 * 4/2013 Lobbezoo ..... A47B 88/10 312/334.12
9,039,109 B2 * 5/2015 Salice ..... A47B 88/04 312/334.44
2001/0003407 A1 * 6/2001 Fraccaro ..... A47B 88/10 312/333
2005/0174021 A1 * 8/2005 Blum ..... A47B 88/14 312/334.13
2010/0045153 A1 * 2/2010 Ritter ..... A47B 88/10 312/334.1
2011/0129171 A1 * 6/2011 Liang ..... A47B 88/0422 384/22
2012/0049712 A1 * 3/2012 Lobbezoo ..... F16C 29/045 312/334.12
2013/0002115 A1 * 1/2013 Friesenecker ..... A47B 88/10 312/334.8
2013/0076221 A1 * 3/2013 Hammerle ..... A47B 88/0466 312/334.1
2013/0127319 A1 * 5/2013 Breisacher ..... A47B 88/10 312/334.23
2014/0009054 A1 * 1/2014 Salice ..... A47B 88/04 312/334.44
2014/0241651 A1 * 8/2014 Greussing ..... A47B 88/10 384/19
2015/0159415 A1 * 6/2015 Rehage ..... A47B 88/10 16/95 R
2015/0230604 A1 * 8/2015 Violand ..... A47B 88/10 312/334.12
2015/0257536 A1 * 9/2015 Chen ..... A47B 88/0466 384/18

* cited by examiner

*Primary Examiner* — Daniel J Troy
*Assistant Examiner* — Kimberley S Wright
(74) *Attorney, Agent, or Firm* — Rosenberg, Klein & Lee

(57) ABSTRACT

A slide rail assembly includes first and second rails, a running carriage, and a pushing member. The second rail can be longitudinally displaced relative to the first rail. The running carriage is slidably mounted to the first rail, carries the second rail, and can be moved together with the second rail in a differential manner with respect to the second rail. The pushing member is movably connected to the first rail and displaceable between a horizontal position and an inclined position. Should an error occur in differential movement of the running carriage, the pushing member is able to be driven by a portion of the second rail to displace from the horizontal position to the inclined position and hence displace the running carriage to correct the error.

19 Claims, 13 Drawing Sheets

SLIDE RAIL ASSEMBLY

FIELD OF THE INVENTION

The present invention relates to a slide rail assembly. More particularly, the present invention relates to a slide rail assembly whose first rail is connected with a correction mechanism for correcting errors in differential movement of a running carriage relative to a second rail.

BACKGROUND OF THE INVENTION

Generally, slide rail assemblies are used with drawers and the like. Such a slide rail assembly typically includes a first rail, a second rail longitudinally displaceable relative to the first rail, and a running carriage mounted between the first rail and the second rail. The running carriage serves to carry the second rail and facilitate displacement of the second rail relative to the first rail. When the second rail is displaced relative to the first rail, the running carriage is moved relative to the second rail in a differential manner; that is to say, the distance by which the running carriage is displaced is a specific proportion of the distance by which the second rail is displaced. However, precise differential movement is not always guaranteed. Errors may occur in differential movement of the running carriage relative to the second rail.

The specification and drawings of U.S. Pat. No. 7,309,115 B2, for example, disclose a pull-out guide assembly for drawers, wherein the pull-out guide assembly includes a support rail (1), a pull-out rail (2), and a running carriage (3) movably mounted between the support rail (1) and the pull-out rail (2). The running carriage (3) can be differentially moved relative to the pull-out rail (2) between a front end position and a rear end position. Also, the running carriage (3) is mounted with a stop device for correcting errors in differential movement of the running carriage (3) relative to the rails. The disclosure of the afore-cited patent is incorporated herein by reference.

SUMMARY OF THE INVENTION

The present invention relates to a slide rail assembly in which a correction mechanism is connected to a first rail and can correct errors in differential movement of a running carriage relative to a second rail.

According to one aspect of the present invention, a slide rail assembly includes a first rail, a second rail, a running carriage, a correction mechanism, and an actuator. The second rail can be longitudinally displaced relative to the first rail. The running carriage is slidably mounted to the first rail, carries the second rail, and can be moved together with the second rail in a differential manner with respect to the second rail. The correction mechanism includes a base connected to the first rail and a pushing member movably connected to the base, wherein the pushing member can be displaced between a horizontal position and an inclined position. The actuator is connected to the second rail and corresponds to the pushing member at the horizontal position. The pushing member at the horizontal position is able to be driven by the actuator to displace to the inclined position and hence displace the running carriage to a position.

According to another aspect of the present invention, a slide rail assembly for use with a cabinet having a drawer includes a first rail, a second rail, a third rail, a running carriage, a pushing member, and an actuator. The first rail is mounted to the cabinet. The second rail is movably mounted between the first rail and the third rail and can be longitudinally displaced relative to the first rail. The third rail carries the drawer. The running carriage is slidably mounted to the first rail, carries the second rail, and can be moved together with the second rail in a differential manner with respect to the second rail. The pushing member is movably connected between the first rail and the second rail and can be displaced between a horizontal position and an inclined position. The actuator is connected to the second rail and corresponds to the pushing member at the horizontal position. The pushing member at the horizontal position is able to be driven by the actuator to displace to the inclined position and hence displace the running carriage to a position. The pushing member is movably connected to the first rail, either directly or via a base.

According to still another aspect of the present invention, a slide rail assembly includes a first rail, a second rail, a running carriage, a pushing member, and an actuator. The second rail can be longitudinally displaced relative to the first rail. The running carriage is slidably mounted to the first rail, carries the second rail, and can be moved together with the second rail in a differential manner with respect to the second rail. The pushing member is movably connected to the first rail and can be displaced between a horizontal position and an inclined position. The actuator is connected to the second rail and corresponds to the pushing member at the horizontal position. The pushing member at the horizontal position is able to be driven by the actuator to displace to the inclined position and hence displace the running carriage to a position.

In some embodiments of any of the above aspects, the second rail can be longitudinally displaced relative to the first rail between a retracted position and an extended position. Should an error occur in differential movement of the running carriage, the actuator drives the pushing member while the second rail is displaced from the retracted position toward the extended position; consequently, the pushing member is displaced from the horizontal position to the inclined position and displaces the running carriage so as to correct the error. The actuator releases the pushing member once the pushing member is at the inclined position.

In some embodiments of any of the above aspects, the actuator is integrally formed with the second rail.

In some embodiments of any of the above aspects, the running carriage carries the second rail via at least one roller.

In some embodiments of any of the above aspects, the base further includes a horizontal portion and an inclined portion inclined with respect to the horizontal portion, and the pushing member can be displaced between the horizontal portion and the inclined portion. Preferably, in theses embodiments, the pushing member further includes at least one contact portion so that, when the pushing member is displaced relative to the base, the at least one contact portion is in contact with one of the horizontal portion and the inclined portion of the base.

In some embodiments of any of the above aspects, the first rail comprises a horizontal portion and an inclined portion inclined with respect to the horizontal portion, and the pushing member is displaceable between the horizontal portion and the inclined portion. Preferably, in these embodiments, the pushing member further comprises at least one contact portion for contact with one of the horizontal portion and the inclined portion of the first rail when the pushing member is displaced relative to the first rail.

One of the advantageous features of employing the present invention is that the correction mechanism on the first rail can correct differential movement errors of the running carriage with respect to the second rail, if any.

BRIEF DESCRIPTION OF THE DRAWINGS

The structure as well as a preferred mode of use and the advantages of the present invention will be best understood by referring to the following detailed description of some illustrative embodiments in conjunction with the accompanying drawings, in which.

DETAILED DESCRIPTION OF THE INVENTION

Figure 1:
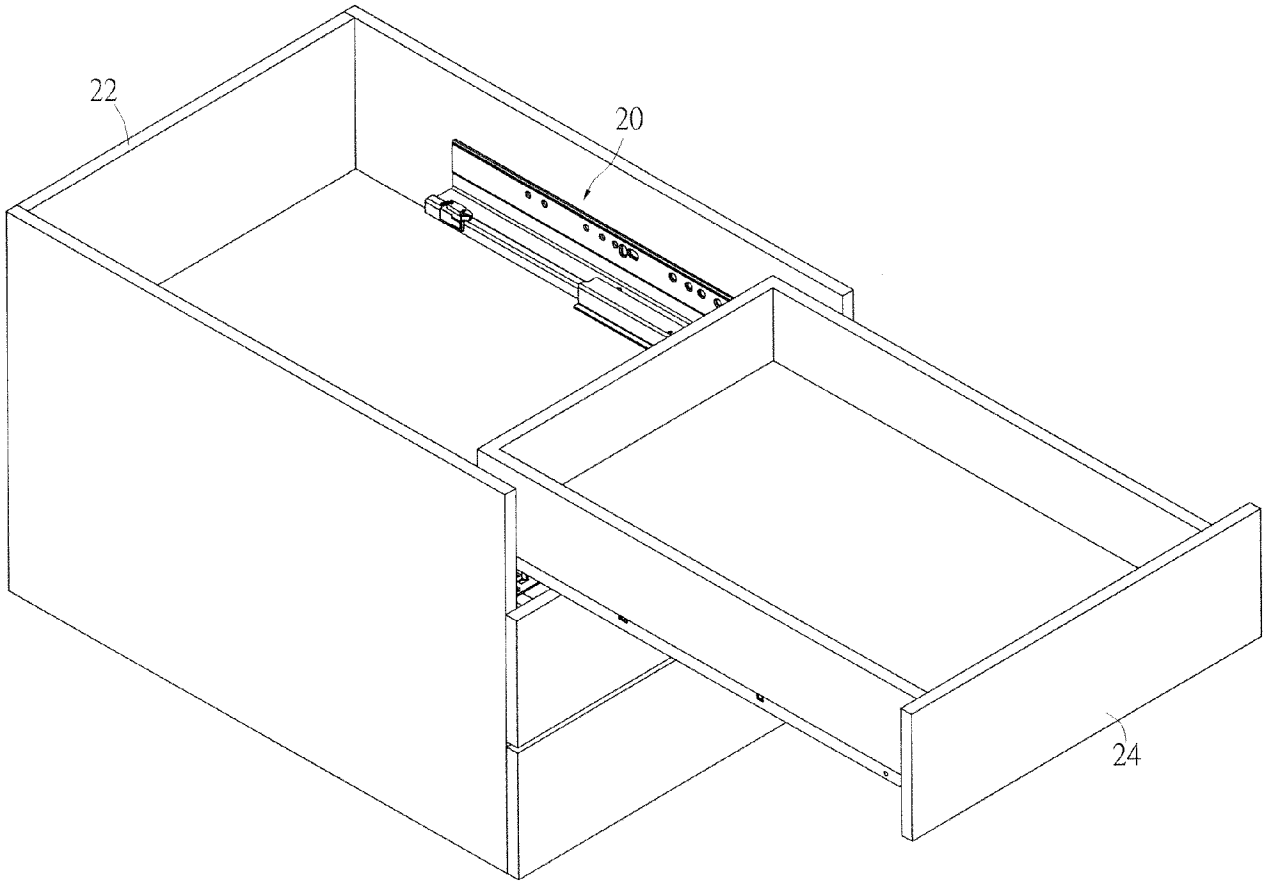
FIG. 1 is a perspective view showing how the slide rail assembly in an embodiment of the present invention is applied to a drawer of a cabinet.

Referring to FIG. 1, the slide rail assembly 20 in an embodiment of the present invention is applied to a cabinet 22 having a drawer 24. The drawer 24 can be pushed into and pulled out of the cabinet 22 via the slide rail assembly 20.

Figure 2:
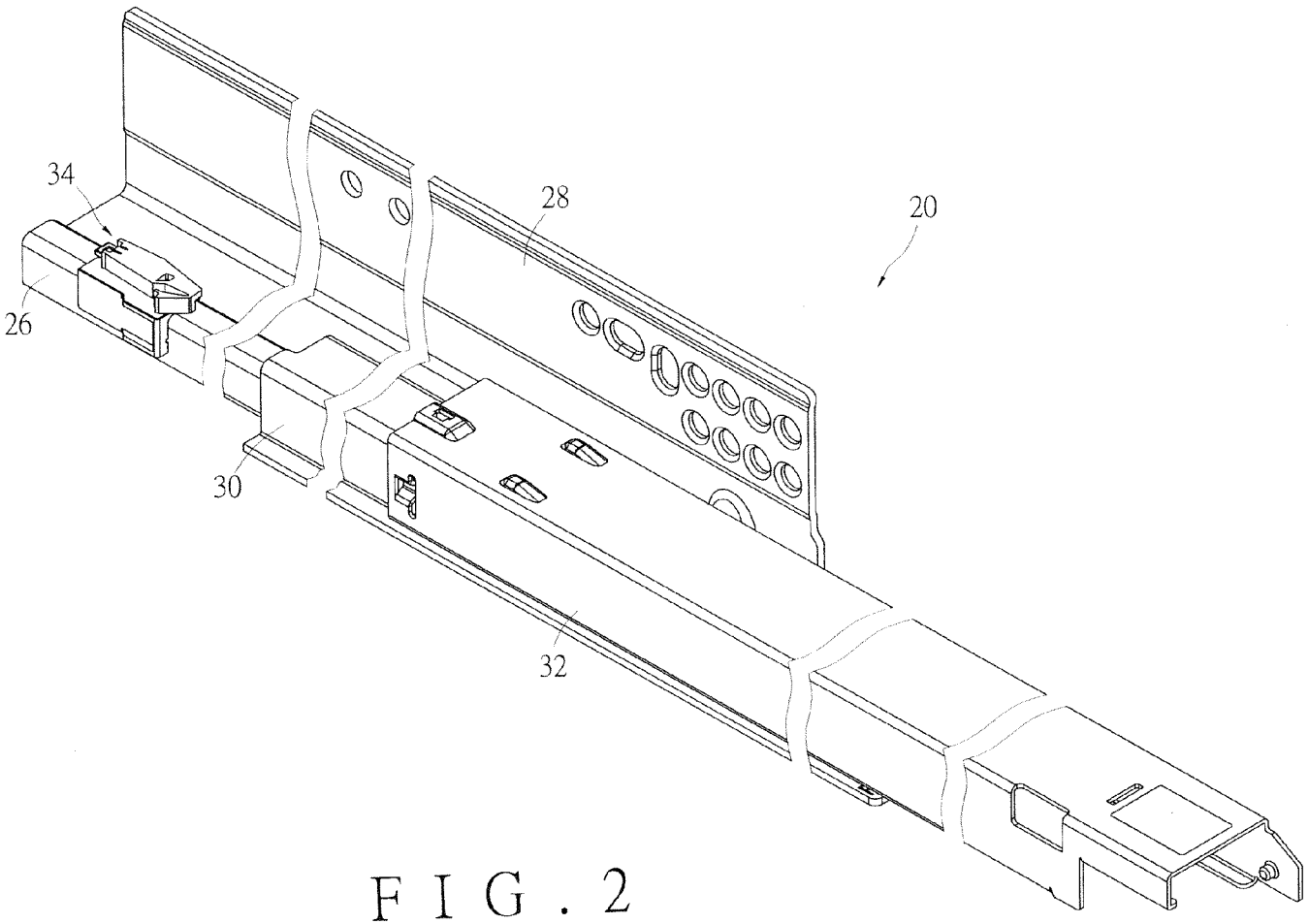
FIG. 2 is a perspective view of the slide rail assembly in an embodiment of the present invention, wherein the slide rail assembly is in an extended state.

FIG. 2 shows the slide rail assembly 20 in an extended state. The slide rail assembly 20 includes a first rail 26, a second rail 30, and a third rail 32. The first rail 26 is mounted to the cabinet 22 via a mounting portion 28. The second rail 30 is movably mounted between the first rail 26 and the third rail 32. The second rail 30 and the third rail 32 can be longitudinally displaced relative to the first rail 26. The third rail 32 serves to carry the drawer 24. A correction mechanism 34 is connected to the first rail 26. The correction mechanism 34 in this embodiment is connected to the first rail 26 at a position adjacent to an end portion of the first rail 26 by way of example only and not as a limitation. As the correction mechanism 34 is connected to the first rail 26, the correction mechanism 34 can be viewed as a part of the first rail 26.

Figure 3:
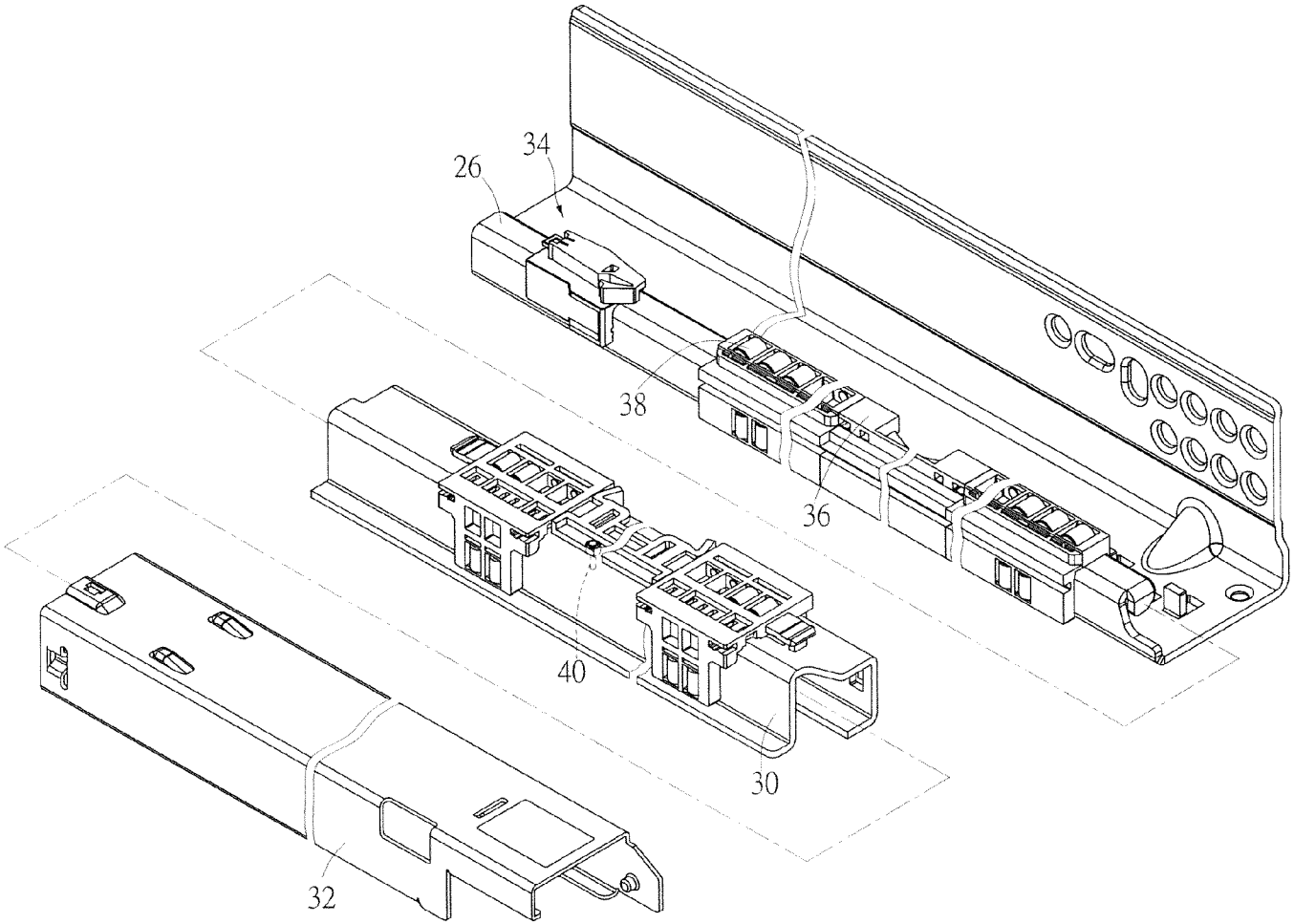
FIG. 3 is an exploded view of the slide rail assembly in an embodiment of the present invention.
Figure 4:
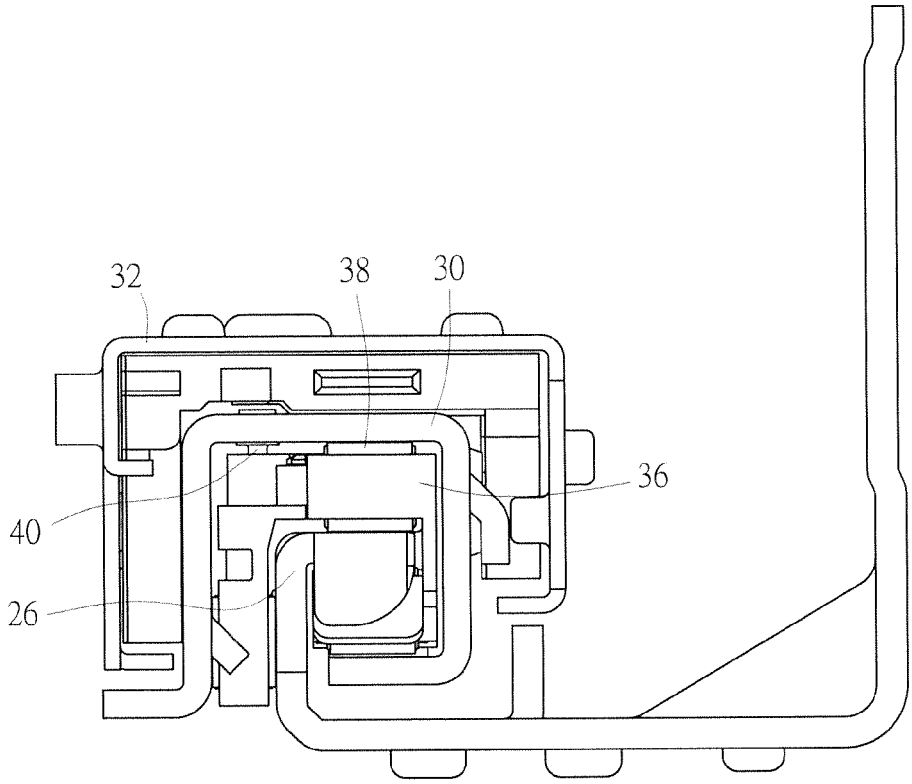
FIG. 4 is a front view of the slide rail assembly in an embodiment of the present invention.

FIG. 3 and FIG. 4 show the first rail 26, the second rail 30, and the third rail 32 in an exploded view and an assembled view respectively. A running carriage 36 is slidably mounted to the first rail 26 and is configured for carrying the second rail 30. The running carriage 36 includes at least one roller 38 (or ball) for carrying the second rail 30 and facilitating displacement of the second rail 30 relative to the first rail 26. In addition, an actuator 40 is connected to the second rail 30. The actuator 40 can be, but is not limited to, a projection or a bar-like member. In some embodiments, the actuator 40 is integrally formed with the second rail 30 and can be viewed as a portion of the second rail 30. When an error occurs in differential movement of the running carriage 36 relative to the second rail 30, the actuator 40 can be operated to drive a portion of the correction mechanism 34 in order for this portion of the correction mechanism 34 to correct the error of the running carriage 36, as explained in more detail below.

Figure 5:
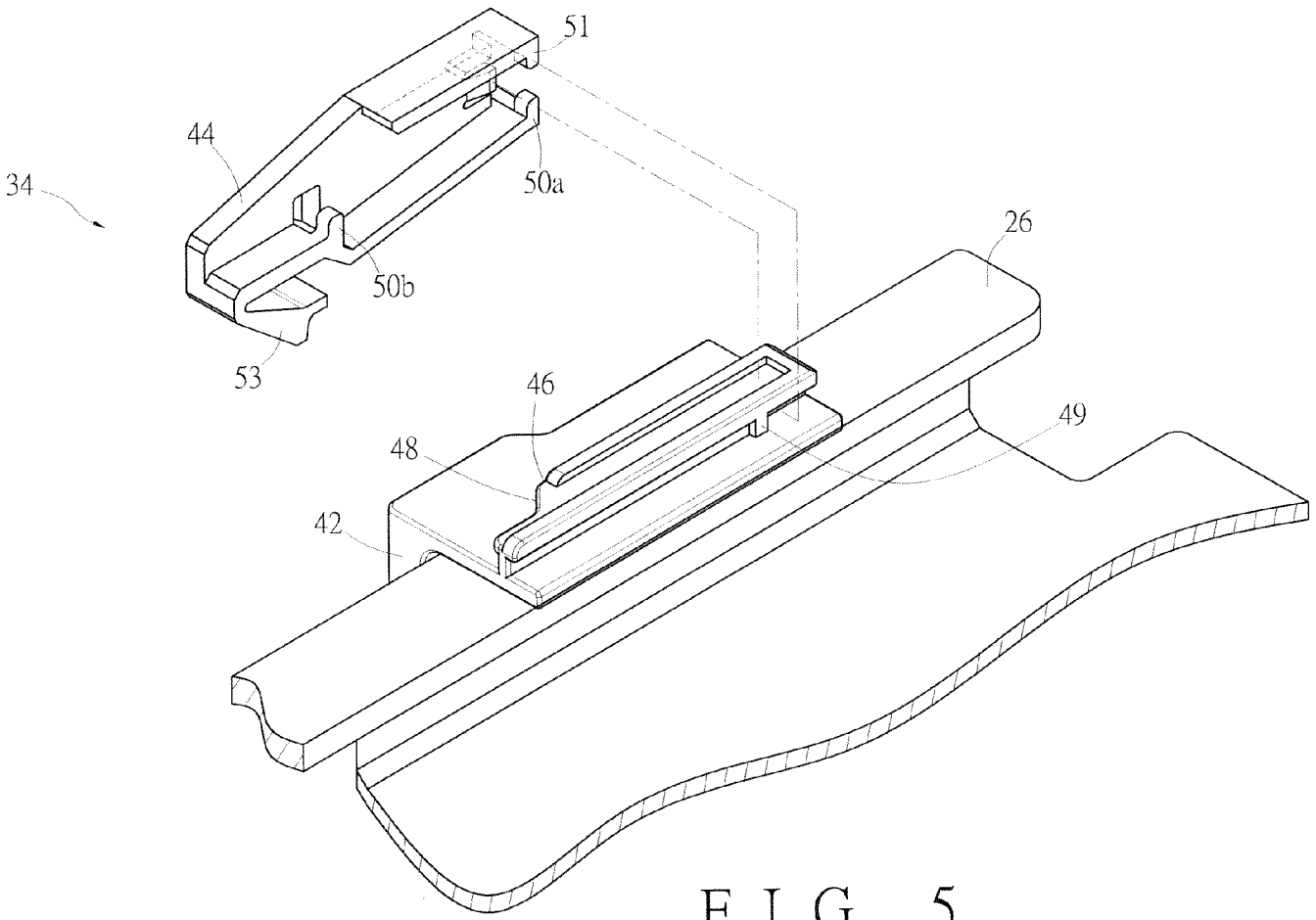
FIG. 5 is an exploded view of the pushing member and the base (which is located on the first rail) in an embodiment of the present invention.

As shown in FIG. 5, the correction mechanism 34 includes a base 42 and a pushing member 44. The base 42 can be connected (mounted) to and thus fixed in position on the first rail 26 or be integrally formed with the first rail 26. The pushing member 44 corresponds to and is movably connected to the base 42. Preferably, the base 42 includes a horizontal portion 46 (which extends in the same direction as the length direction of the first rail 26), an inclined portion 48 inclined at an angle with respect to the horizontal portion 46, and a blocking wall 49 located on the other side of the base 42 (i.e., on a different side from the horizontal portion 46). Preferably, the pushing member 44 includes at least one contact portion, a to-be-blocked portion 51 to be blocked by the blocking wall 49 of the base 42, and an arm portion 53 elastically connected to the pushing member 44. In this embodiment, the at least one contact portion includes a first contact portion 50*a* and a second contact portion 50*b* by way of example.

Figure 6A:
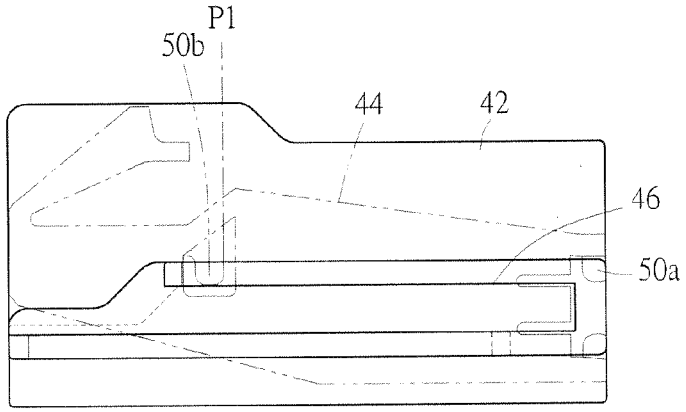
FIG. 6A is a schematic drawing in which the pushing member in an embodiment of the present invention is at a horizontal position with respect to the base.
Figure 6B:
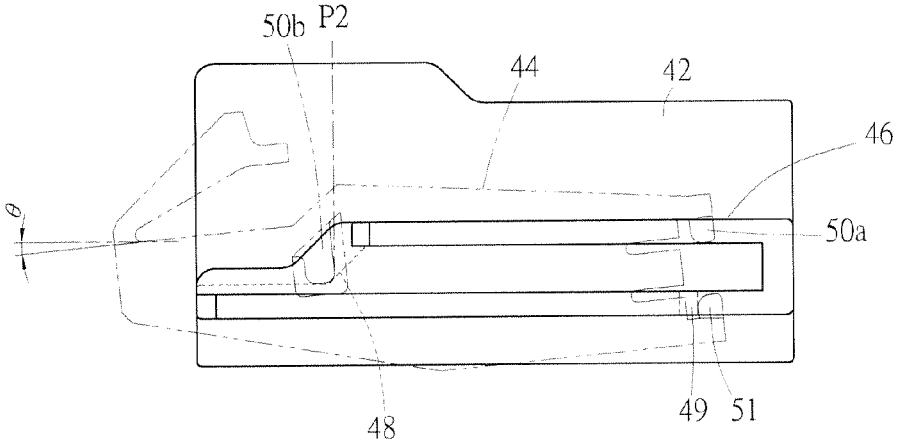
FIG. 6B is a schematic drawing in which the pushing member in FIG. 6A is at an inclined position, and tilted at an angle, with respect to the base.

Referring to FIG. 6A and FIG. 6B, when the pushing member 44 is at a horizontal position (first position) P1 with respect to the base 42, both the first contact portion 50*a* and the second contact portion 50*b* of the pushing member 44 are in contact with and lie on the horizontal portion 46 of the base 42. Once the pushing member 44 is displaced from the horizontal position P1 to an inclined position (second position) P2 with respect to the base 42, the first contact portion 50*a* of the pushing member 44 is in contact with and lies on the horizontal portion 46 of the base 42 while the second contact portion 50*b* of the pushing member 44 is in contact with and lies on the inclined portion 48 of the base 42; as a result, the pushing member 44 is tilted with respect to the base 42 by an angle θ. When the pushing member 44 is at the inclined position P2, the to-be-blocked portion 51 of the pushing member 44 is blocked by the blocking wall 49 of the base 42 such that the pushing member 44 is kept at the inclined position P2.

Figure 7A:
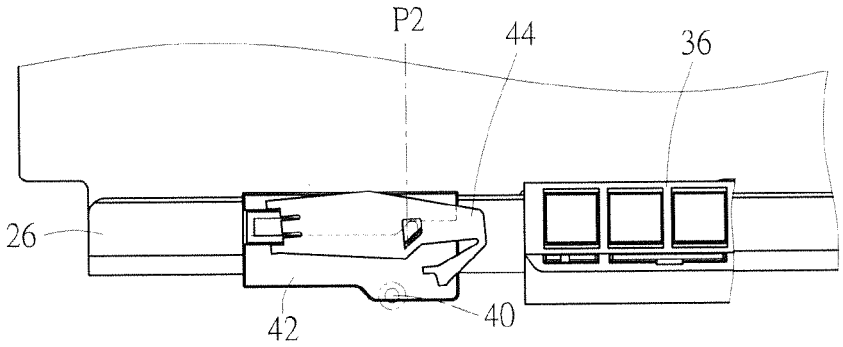
FIG. 7A is a schematic drawing in which the second rail in an embodiment of the present invention is about to be displaced relative to the first rail from a retracted position toward an extended position, and in which the pushing member is at an inclined position with respect to the base while the running carriage is capable of normal differential movement.
Figure 7B:
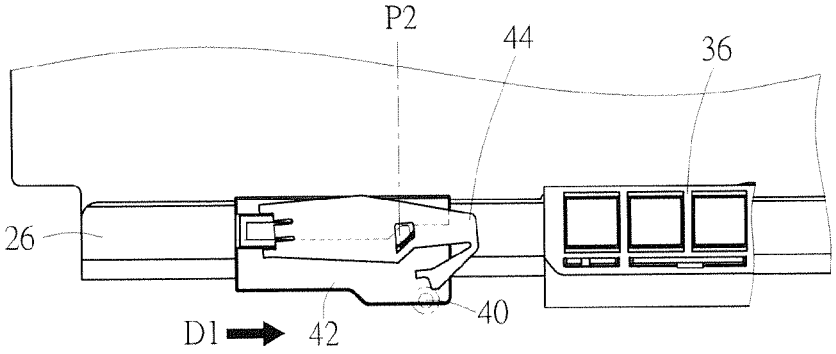
FIG. 7B schematically shows how the second rail in FIG. 7A is displaced relative to the first rail from the retracted position toward the extended position while the pushing member is at the inclined position with respect to the base and while the running carriage is differentially moved in a normal manner.
Figure 7C:
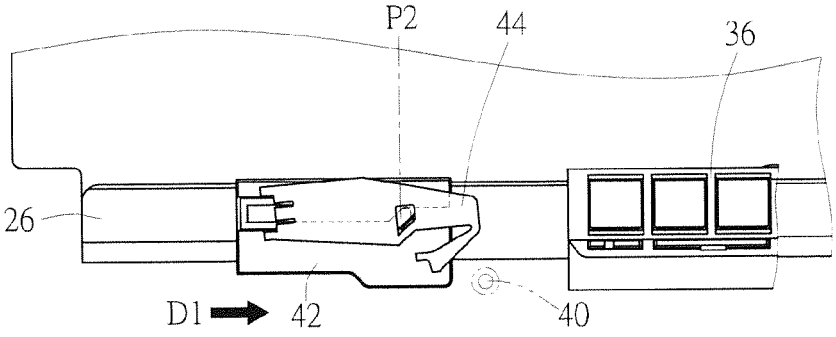
FIG. 7C schematically shows how the second rail in FIG. 7B is further displaced relative to the first rail from the retracted position toward the extended position while the pushing member is at the inclined position with respect to the base and while the running carriage is differentially moved in a normal manner.

FIG. 7A to FIG. 7C show the pushing member 44 at the inclined position P2 with respect to the base 42. FIG. 7A to FIG. 7C also show a normal state in which, while the second rail 30 is longitudinally displaced relative to the first rail 26 in a first direction D1 from a retracted position toward an extended position (please note that, in FIG. 7A~FIG. 7C, the displacement and position of the second rail 30 relative to the first rail 26 are represented by those of the actuator 40), the running carriage 36 is moved together with the second rail (the actuator 40) in the intended (or normal) differential manner with respect to the second rail (the actuator 40). That is to say, when the second rail (the actuator 40) is displaced in the first direction D1 by a certain distance, the running carriage 36 is synchronously and precisely moved by a distance which is a specific proportion (e.g., one half) of the distance by which the second rail (the actuator 40) is displaced. It should be pointed out that, when the pushing member 44 is at the inclined position P2, the actuator 40 does not correspond to any portion (e.g., the arm portion 53) of the pushing member 44 and therefore is unable to drive the pushing member 44 while the second rail is displaced relative to the first rail 26 from the retracted position toward the extended position.

Figure 8A:
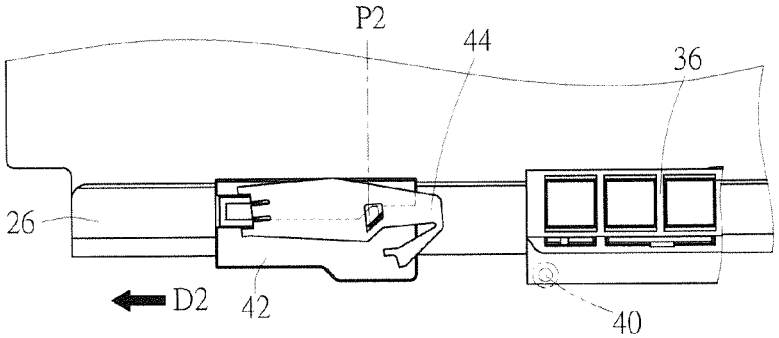
FIG. 8A schematically shows how the second rail in an embodiment of the present invention is displaced relative to the first rail from an extended position toward a retracted position while the pushing member is at an inclined position with respect to the base and while the running carriage is differentially moved in a normal manner.
Figure 8B:
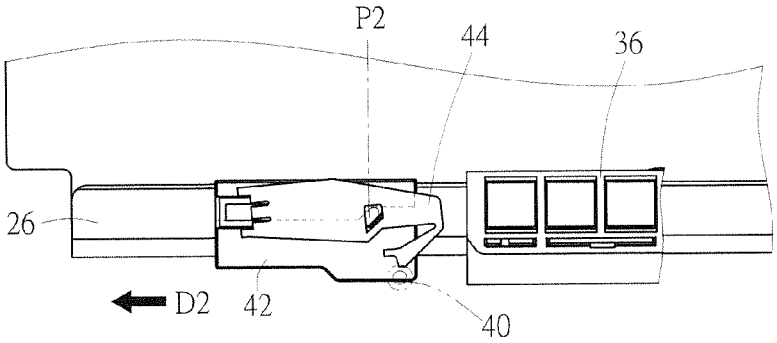
FIG. 8B schematically shows how the second rail in FIG. 8A is further displaced relative to the first rail from the extended position toward the retracted position while the pushing member is at the inclined position with respect to the base and while the running carriage is differentially moved in a normal manner.
Figure 8C:
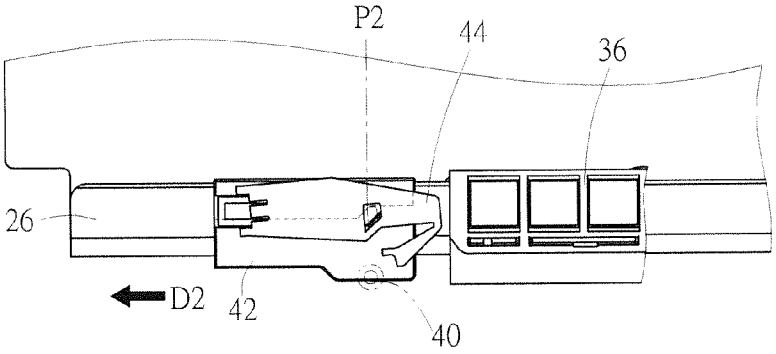
FIG. 8C schematically shows how the second rail in FIG. 8B is further displaced relative to the first rail from the extended position toward the retracted position while the pushing member is at the inclined position with respect to the base and while the running carriage is differentially moved in a normal manner.
Figure 9A:
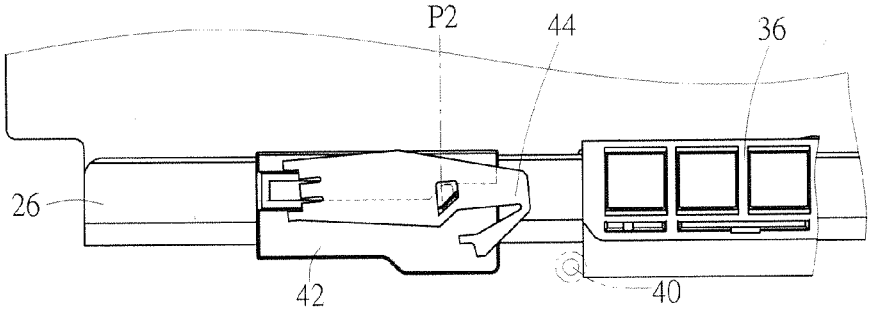
FIG. 9A is a schematic drawing in which the second rail in an embodiment of the present invention is about to be displaced relative to the first rail from an extended position toward a retracted position, and in which the pushing member is at an inclined position with respect to the base while the running carriage is incapable of normal differential movement.
Figure 9B:
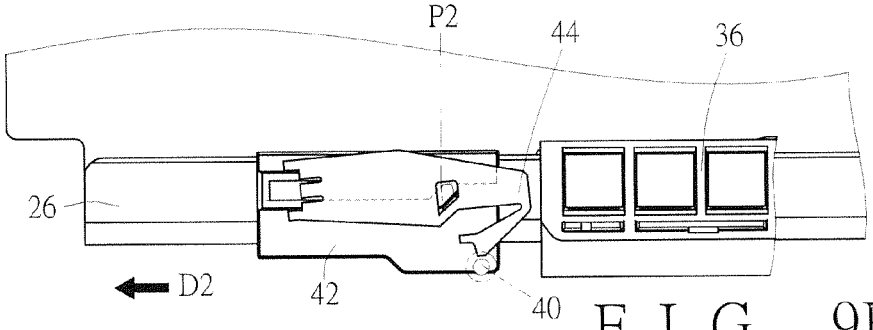
FIG. 9B schematically shows how the second rail in FIG. 9A is displaced relative to the first rail from the extended position toward the retracted position while the pushing member is at the inclined position with respect to the base and while the running carriage is differentially moved in an abnormal manner.
Figure 9C:
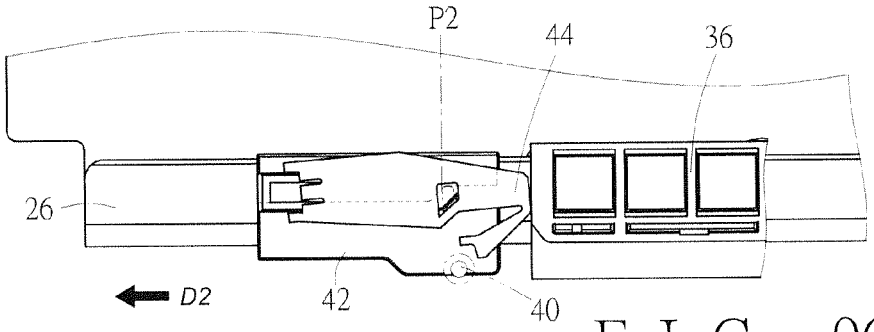
FIG. 9C schematically shows how the second rail in FIG. 9B is further displaced relative to the first rail from the extended position toward the retracted position while the pushing member is at the inclined position with respect to the base and while the running carriage is differentially moved in an abnormal manner, and how the running carriage collides with the pushing member as a result.
Figure 9D:
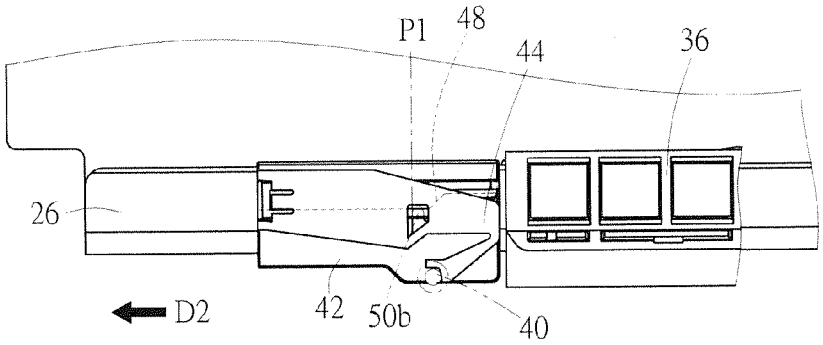
FIG. 9D schematically shows how the second rail in FIG. 9C is further displaced relative to the first rail from the extended position toward the retracted position while the running carriage is differentially moved in an abnormal manner, and how the running carriage pushes the pushing member to the horizontal position as a result.

FIG. 8A to FIG. 8C also show the pushing member 44 at the inclined position P2 with respect to the base 42. In addition, FIG. 8A to FIG. 8C show a normal state in which, while the second rail 30 is longitudinally displaced relative to the first rail 26 in a second direction D2 from the extended position toward the retracted position (please note that, in FIG. 8A~FIG. 8C, the displacement and position of the second rail 30 relative to the first rail 26 are represented by those of the actuator 40), the running carriage 36 is differentially moved relative to the second rail (the actuator 40) in the intended (or normal) manner.

However, after the second rail (the actuator 40) is repeatedly displaced back and forth relative to the first rail 26 in the first direction D1 and the second direction D2, it is no longer guaranteed that the distance by which the running carriage 36 is differentially moved will be precisely the preset proportion of the distance by which the second rail (the actuator 40) is displaced, the reason being the difference in rolling/sliding speed between the roller and the rails or some external factors. As a result, an abnormal condition arises when the running carriage 36 is differentially moved relative to the second rail (the actuator 40).

In FIG. 9A to FIG. 9D, wherein the pushing member 44 is initially at the inclined position P2 with respect to the base 42, an abnormal state is shown in which, due to an error in differential movement of the running carriage 36 relative to the second rail (the actuator 40), there is also an error in the position of the running carriage 36 while the running carriage 36 is differentially moved relative to the second rail (the actuator 40). In other words, the distance by which the running carriage 36 is differentially moved relative to the second rail (the actuator 40) is not the preset proportion of the distance by which the second rail (the actuator 40) is displaced. In the presence of such errors, the running carriage 36 contacts the pushing member 44 (see FIG. 9C) while the second rail (the actuator 40) is retracted from the extended position in the second direction D2. If the second rail (the actuator 40) is further displaced relative to the first rail 26 in the second direction D2 toward the retracted position, the pushing member 44 will be driven by the running carriage 36 such that the second contact portion 50*b* of the pushing member 44 moves from the inclined portion 48 of the base 42 to the horizontal portion 46 of the base 42; in consequence, the pushing member 44 is displaced relative to the base 42 from the inclined position P2 to the horizontal position P1 (see FIG. 9D).

Figure 10A:
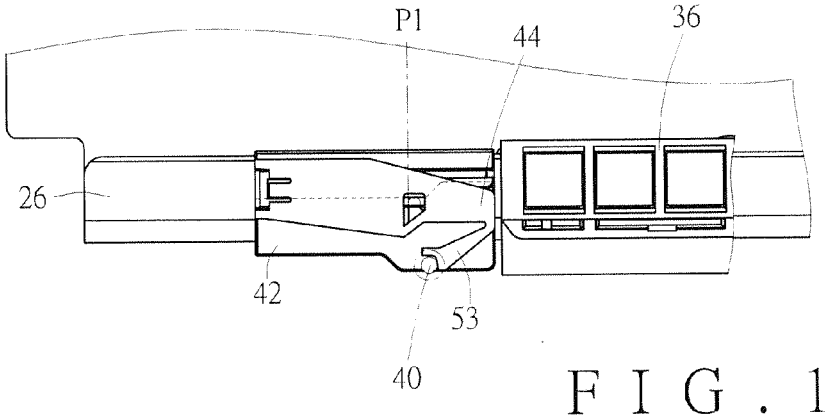
FIG. 10A is a schematic drawing in which the actuator in an embodiment of the present invention corresponds to the pushing member at the horizontal position due to abnormal differential movement of the running carriage.
Figure 10B:
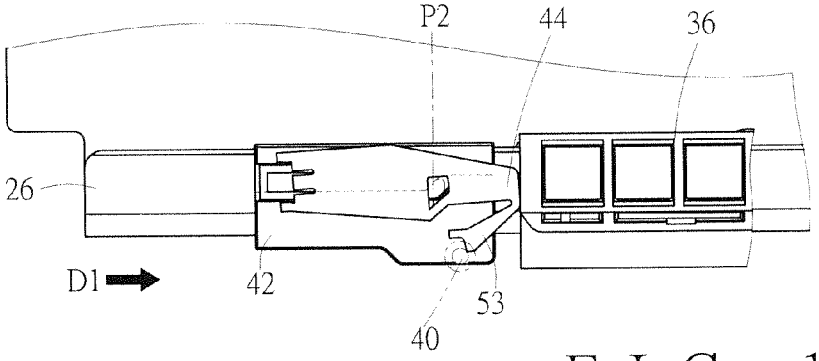
FIG. 10B schematically shows how the actuator in FIG. 10A drives the pushing member from the horizontal position to the inclined position while the running carriage is differentially moved in an abnormal manner, and how the pushing member at the inclined position corrects the differential movement error of the running carriage.
Figure 10C:
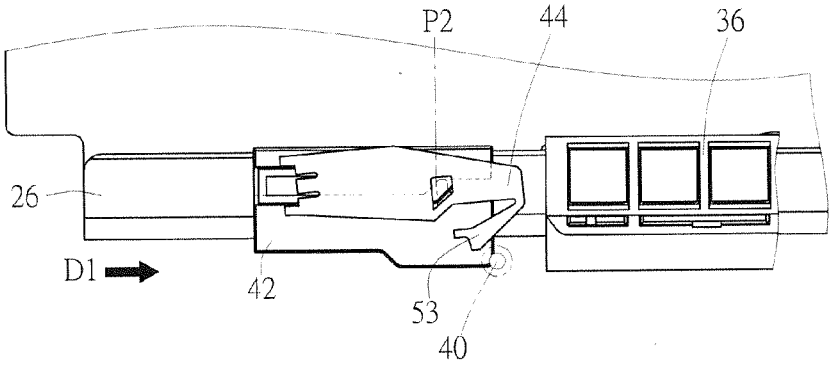
FIG. 10C is a schematic drawing in which the pushing member in FIG. 10B has corrected the differential movement error of the running carriage so that the running carriage is once again capable of normal differential movement relative to the second rail.
Figure 11A:
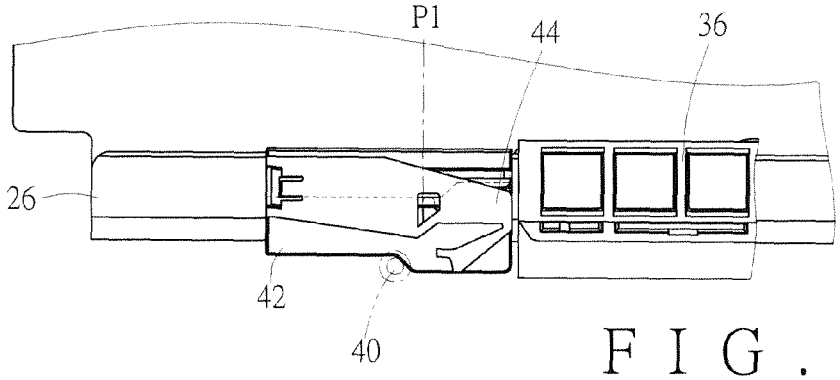
FIG. 11A is a schematic drawing in which the second rail in an embodiment of the present invention is in a retracted state, and in which the pushing member is at a horizontal position with respect to the base while the running carriage is capable of normal differential movement.
Figure 11B:
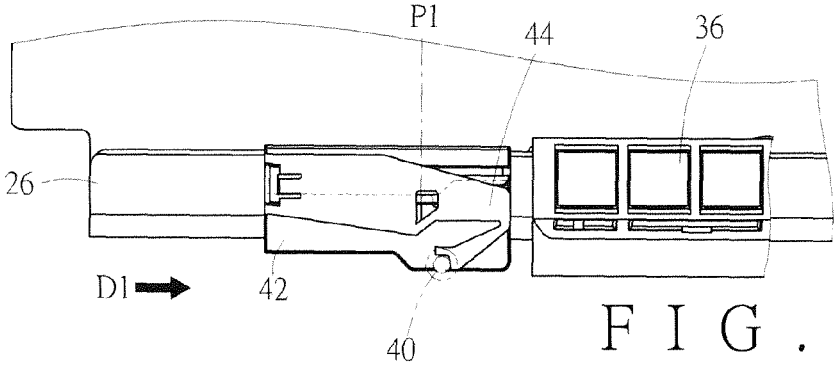
FIG. 11B schematically shows how the second rail in FIG. 11A is displaced relative to the first rail from the retracted position toward an extended position while the pushing member is at the horizontal position with respect to the base and while the running carriage is differentially moved in a normal manner, and how the actuator ends up corresponding to the pushing member.
Figure 11C:
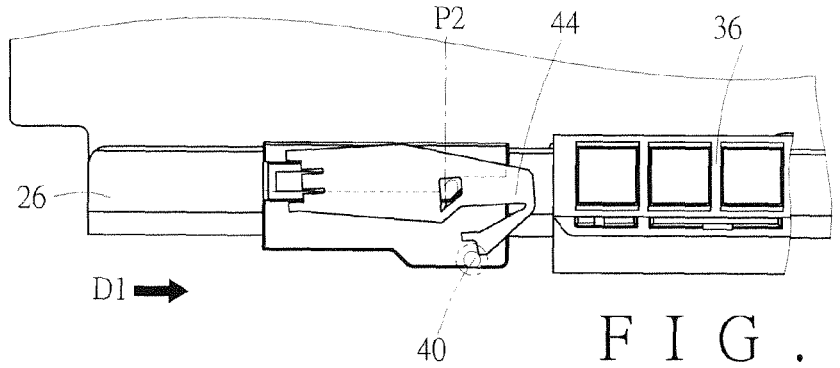
FIG. 11C schematically shows how the second rail in FIG. 11B is further displaced relative to the first rail from the retracted position toward the extended position while the running carriage is differentially moved in a normal manner, and how the actuator drives the pushing member to the inclined position as a result.
Figure 11D:
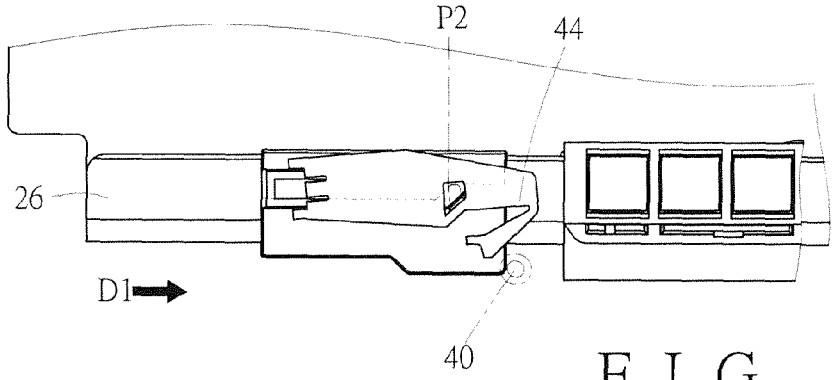
FIG. 11D schematically shows how the second rail in FIG. 11C is further displaced relative to the first rail from the retracted position toward the extended position while the running carriage is differentially moved in a normal manner, and how the actuator releases the pushing member at the inclined position.

A detailed description of how to correct the aforesaid abnormal condition is given below with reference to FIG. 10A to FIG. 10C, in which the pushing member 44 is initially at the horizontal position P1 with respect to the base 42, and in which the actuator 40 corresponds to the arm portion 53 of the pushing member 44 at the horizontal position P1. To correct the abnormal condition, the second rail (the actuator 40) is displaced relative to the first rail 26 in the first direction D1 from the retracted position toward the extended position so that, during the displacement, the actuator 40 pushes the arm portion 53 due to the corresponding relationship between the actuator 40 and the pushing member 44. The arm portion 53, in turn, drives the pushing member 44 from the horizontal position P1 with respect to the base 42 to the inclined position P2, in order for the pushing member 44 to displace the running carriage 36 to a predetermined position (see FIG. 10B) where the running carriage 36 can be differentially moved relative to the second rail (the actuator 40) in a normal manner. Thus, the error in differential movement of the running carriage 36 relative to the second rail (the actuator 40) is corrected. If the second rail (the actuator 40) is further displaced relative to the first rail 26 in the first direction D1, the actuator 40 will release the pushing member 44 having been driven to the inclined position P2; in consequence, the actuator 40 no longer corresponds to the arm portion 53 of the pushing member 44 and can drive the pushing member 44 no more, thus allowing the running carriage 36 to be differentially moved relative to the second rail (the actuator 40) in a normal manner again.

Reference is now made to FIG. 11A to FIG. 11D. Once capable of normal differential movement, the running carriage 36 can be moved relative to the second rail 30 (the actuator 40) in the intended differential manner as the second rail 30 is displaced relative to the first rail 26 in the first direction D1 from the retracted position (please note that, in FIG. 11A~FIG. 11D, the displacement and position of the second rail 30 relative to the first rail 26 are represented by those of the actuator 40). Should the pushing member 44 be at the horizontal position P1 with respect to the base 42, the actuator 40 will drive the pushing member 44 from the horizontal position P1 to the inclined position P2 during displacement. Now that the running carriage 36 has been synchronously and differentially moved along with the second rail (the actuator 40) in a normal manner by a certain distance in the first direction D1, the pushing member 44 at the inclined position 92 is unable to drive the running carriage 36 (i.e., the pushing member 44 will not correct differential movement of the running carriage 36).

Figure 12A:
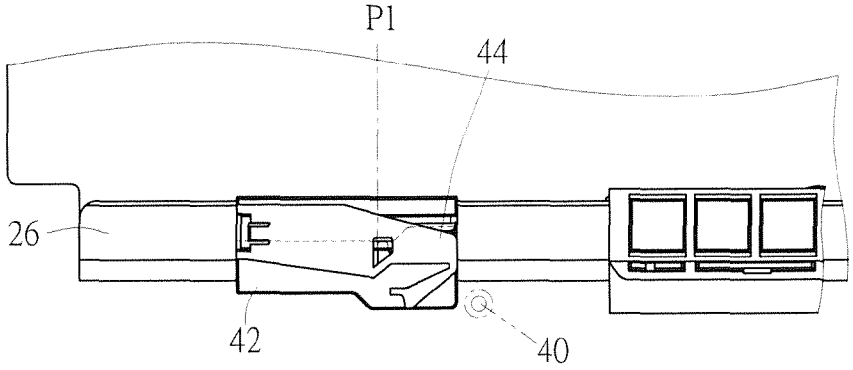
FIG. 12A is a schematic drawing in which the second rail in an embodiment of the present invention is about to be displaced relative to the first rail from an extended position toward a retracted position, and in which the pushing member is at a horizontal position with respect to the base while the running carriage is capable of normal differential movement.
Figure 12B:
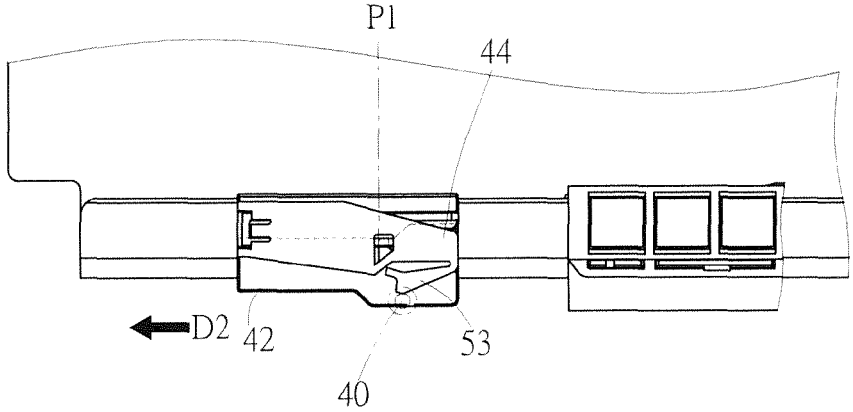
FIG. 12B schematically shows how the second rail in FIG. 12A is displaced relative to the first rail from the extended position toward the retracted position while the pushing member is at the horizontal position with respect to the base and while the running carriage is differentially moved in a normal manner, and how the actuator pushes the arm portion of the pushing member as a result.
Figure 12C:
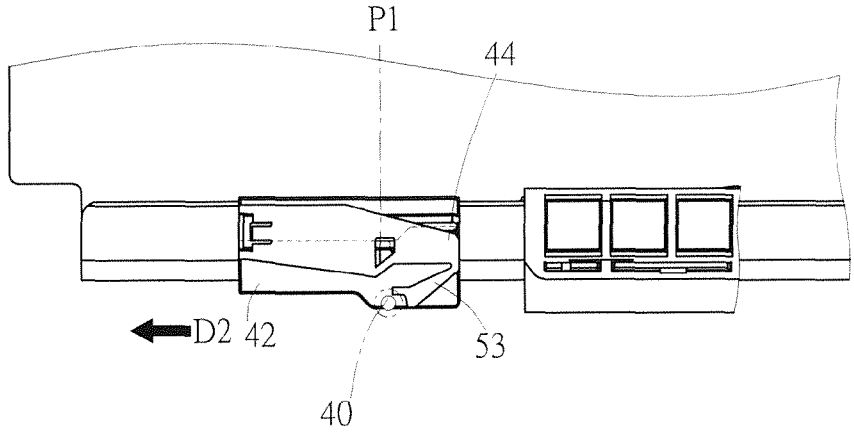
FIG. 12C schematically shows how the second rail in FIG. 12B is further displaced relative to the first rail from the extended position toward the retracted position while the pushing member is at the horizontal position with respect to the base and while the running carriage is differentially moved in a normal manner, and how the actuator ends up corresponding to the pushing member.

In FIG. 12A to FIG. 12C, the pushing member 44 is at the horizontal position P1 with respect to the base 42 due to external factors or by accident. In such a case, the second rail 30 can be displaced relative to the first rail 26 in the second direction D2 from the extended position (please note that, in FIG. 12A~FIG. 12C, the displacement and position of the second rail 30 relative to the first rail 26 are represented by those of the actuator 40) in order for the actuator 40 to push and thereby elastically bend the arm portion 53 of the pushing member 44 (see FIG. 12B) during the displacement. Once moved past the arm portion 53 (see FIG. 12C), the actuator 40 corresponds to the arm portion 53 of the pushing member 44 again.

Figure 13A:
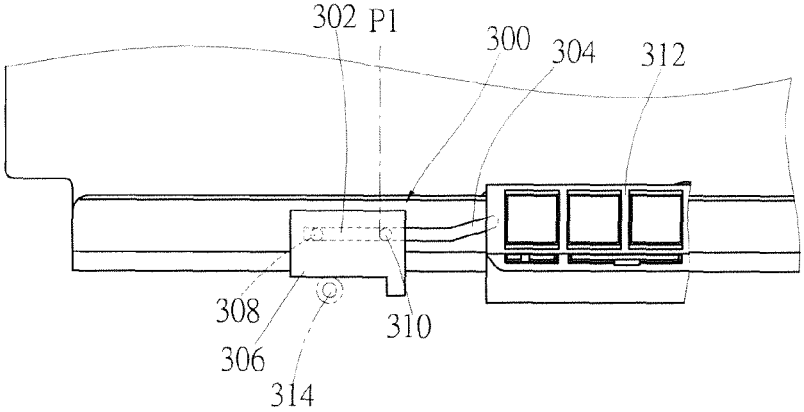
FIG. 13A schematically shows the correction mechanism in another embodiment of the present invention, wherein the pushing member corresponds to the horizontal portion of the first rail and is therefore at the horizontal position.
Figure 13B:
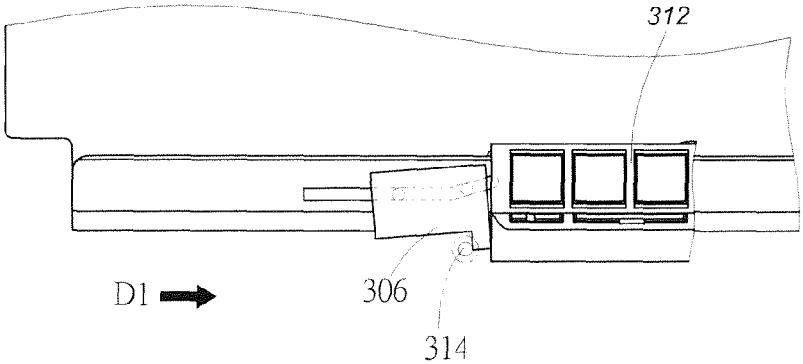
FIG. 13B is another schematic drawing of the correction mechanism in FIG. 13A, showing in particular how the pushing member is driven by the actuator into contact with the running carriage.
Figure 13C:
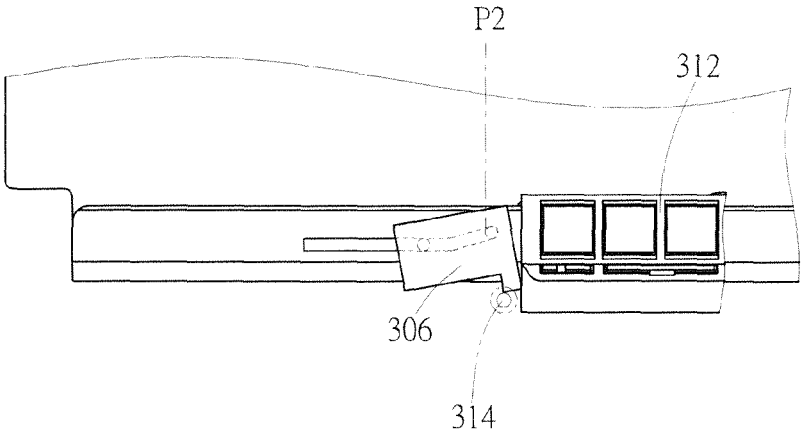
FIG. 13C is yet another schematic drawing of the correction mechanism in FIG. 13A, showing in particular how the pushing member is driven by the actuator to the inclined portion of the first rail and hence to the inclined position, and how the pushing member at the inclined position pushes the running carriage to correct the differential movement error of the running carriage.

FIG. 13A to FIG. 13C show the correction mechanism 300 in another embodiment of the present invention. The correction mechanism 300 is different from its counterpart in the previous embodiment substantially in that the first rail 26 is directly formed with a horizontal portion 302 and an inclined portion 304.

While the pushing member 306 is displaced, at least one contact portion of the pushing member 306 (e.g., the first contact portion 308 or the second contact portion 310) is in contact with one of the horizontal portion 302 and the inclined portion 304. Should an error occur in differential movement of the running carriage 312, the second rail (the actuator 314) can be displaced in the first direction D1 from the retracted position toward the extended position in order for the actuator 314 to drive the pushing member 306 from the horizontal position P1 to the inclined position P2, and for the pushing member 306 at the inclined position P2 to displace, and thereby correct the differential movement error of, the running carriage 312. The actuator 314 releases the pushing member 306 once the pushing member 306 is at the inclined position P2.

While the present invention has been disclosed by way of the foregoing preferred embodiments, the embodiments are not intended to be restrictive of the present invention. The scope of patent protection sought by the applicant is defined by the appended claims.

The invention claimed is:

1. A slide rail assembly, comprising:

a first rail;

a second rail longitudinally displaceable relative to the first rail;

a running carriage slidably mounted to the first rail, carrying the second rail, and movable together with the second rail in a differential manner with respect to the second rail;

a correction mechanism comprising a base connected to the first rail and a pushing member movably connected to the base, wherein the pushing member is displaceable between a horizontal position and an inclined position, the base including a horizontal portion and an inclined portion inclined with respect to the horizontal portion, and the pushing member being displaceable between the horizontal portion and the inclined portion; and an actuator connected to the second rail, the actuator corresponding to the pushing member when the pushing member is at the horizontal position;

wherein the pushing member at the horizontal position is able to be driven by the actuator to displace to the inclined position and hence displace the running carriage to a position.

2. The slide rail assembly of claim 1, wherein the second rail is longitudinally displaceable relative to the first rail between a retracted position and an extended position; and wherein should an error occur in differential movement of the running carriage, the actuator drives the pushing member while the second rail is displaced from the retracted position toward the extended position, so that the pushing member is displaced from the horizontal position to the inclined position and displaces the running carriage to correct the error, the actuator releasing the pushing member once the pushing member is at the inclined position.

3. The slide rail assembly of claim 1, wherein the actuator is integrally formed with the second rail.

4. The slide rail assembly of claim 1, wherein the running carriage carries the second rail via at least one roller.

5. The slide rail assembly of claim 1, wherein the pushing member further comprises at least one contact portion for contact with one of the horizontal portion and the inclined portion of the base when the pushing member is displaced relative to the base.

6. A slide rail assembly applicable to a cabinet having a drawer, the slide rail assembly comprising:

a first rail mounted to the cabinet;

a second rail and a third rail, wherein the second rail is movably mounted between the first rail and the third rail and is longitudinally displaceable relative to the first rail, and the third rail carries the drawer;

a running carriage slidably mounted to the first rail, carrying the second rail, and movable together with the second rail in a differential manner with respect to the second rail;

a pushing member movably connected between the first rail and the second rail and displaceable between a horizontal position and an inclined position, the pushing member being movably connected to the first rail, the first rail comprising a horizontal portion and an inclined portion inclined with respect to the horizontal portion, and the pushing member being displaceable between the horizontal portion and the inclined portion; and an actuator connected to the second rail, the actuator corresponding to the pushing member when the pushing member is at the horizontal position;

wherein the pushing member at the horizontal position is able to be driven by the actuator to displace to the inclined position and hence displace the running carriage to a position.

7. The slide rail assembly of claim 6, wherein the second rail is longitudinally displaceable relative to the first rail between a retracted position and an extended position; and wherein should an error occur in differential movement of the running carriage, the actuator drives the pushing member while the second rail is displaced from the retracted position toward the extended position, so that the pushing member is displaced from the horizontal position to the inclined position and displaces the running carriage to correct the error, the actuator releasing the pushing member once the pushing member is at the inclined position.

8. The slide rail assembly of claim 6, wherein the actuator is integrally formed with the second rail.

9. The slide rail assembly of claim 6, further comprising a base connected to the first rail, wherein the pushing member is movably connected to the base.

10. A slide rail assembly applicable to a cabinet having a drawer, the slide rail assembly comprising:

a first rail mounted to the cabinet;

a second rail and a third rail, wherein the second rail is movably mounted between the first rail and the third rail and is longitudinally displaceable relative to the first rail, and the third rail carries the drawer;

a running carriage slidably mounted to the first rail, carrying the second rail, and movable together with the second rail in a differential manner with respect to the second rail;

a pushing member movably connected between the first rail and the second rail and displaceable between a horizontal position and an inclined position;

an actuator connected to the second rail, the actuator corresponding to the pushing member when the pushing member is at the horizontal position, wherein the pushing member at the horizontal position is able to be driven by the actuator to displace to the inclined position and hence displace the running carriage to a position; and a base connected to the first rail, the pushing member movably connected to the base, wherein the base includes a horizontal portion and an inclined portion inclined with respect to the horizontal portion, and the pushing member is displaceable between the horizontal portion and the inclined portion.

11. The slide rail assembly of claim 10, wherein the pushing member further comprises at least one contact portion for contact with one of the horizontal portion and the inclined portion of the base when the pushing member is displaced relative to the base.

12. The slide rail assembly of claim 6, wherein the pushing member further comprises at least one contact portion for contact with one of the horizontal portion and the inclined portion of the first rail when the pushing member is displaced relative to the first rail.

13. A slide rail assembly, comprising:

a first rail, the first rail including a horizontal portion and an inclined portion inclined with respect to the horizontal portion, and;

a second rail longitudinally displaceable relative to the first rail;

a running carriage slidably mounted to the first rail, carrying the second rail, and movable together with the second rail in a differential manner with respect to the second rail;

a pushing member movably connected to the first rail and displaceable between the horizontal portion and the inclined portion of the first rail to thereby be displaceable between a horizontal position and an inclined position; and an actuator connected to the second rail, the actuator corresponding to the pushing member when the pushing member is at the horizontal position;

wherein the pushing member at the horizontal position is able to be driven by the actuator to displace to the inclined position and hence displace the running carriage to a position.

14. The slide rail assembly of claim 13, wherein the second rail is longitudinally displaceable relative to the first rail between a retracted position and an extended position; and wherein should an error occur in differential movement of the running carriage, the actuator drives the pushing member while the second rail is displaced from the retracted position toward the extended position, so that the pushing member is displaced from the horizontal position to the inclined position and displaces the running carriage to correct the error, the actuator releasing the pushing member once the pushing member is at the inclined position.

15. The slide rail assembly of claim 13, wherein the actuator is integrally formed with the second rail.

16. The slide rail assembly of claim 13, wherein the running carriage carries the second rail via at least one roller.

17. The slide rail assembly of claim 13, wherein the pushing member further comprises at least one contact portion for contact with one of the horizontal portion and the inclined portion of the first rail when the pushing member is displaced relative to the first rail.

18. The slide rail assembly of claim 10, wherein the second rail is longitudinally displaceable relative to the first rail between a retracted position and an extended position; and wherein should an error occur in differential movement of the running carriage, the actuator drives the pushing member while the second rail is displaced from the retracted position toward the extended position, so that the pushing member is displaced from the horizontal position to the inclined position and displaces the running carriage to correct the error, the actuator releasing the pushing member once the pushing member is at the inclined position.

19. The slide rail assembly of claim 18, wherein the actuator is integrally formed with the second rail.

* * * * *